US008507167B2

(12) United States Patent
Saito et al.

(10) Patent No.: US 8,507,167 B2
(45) Date of Patent: Aug. 13, 2013

(54) TONER FOR DEVELOPING ELECTROSTATIC CHARGE IMAGE, ELECTROSTATIC CHARGE IMAGE DEVELOPER, TONER CARTRIDGE, PROCESS CARTRIDGE AND IMAGE FORMING APPARATUS

(75) Inventors: Yutaka Saito, Kanagawa (JP); Michio Take, Kanagawa (JP); Yoshifumi Iida, Kanagawa (JP); Sakon Takahashi, Kanagawa (JP); Motoko Sakai, Kanagawa (JP); Katsuyuki Kitajima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

(21) Appl. No.: 12/852,835

(22) Filed: Aug. 9, 2010

(65) Prior Publication Data

US 2011/0229811 A1 Sep. 22, 2011

(30) Foreign Application Priority Data

Mar. 18, 2010 (JP) ..... 2010-063226

(51) Int. Cl.
*G03G 9/087* (2006.01)
*G03G 9/113* (2006.01)
*G03G 9/097* (2006.01)

(52) U.S. Cl.
USPC ..... 430/108.7; 430/108.6; 430/108.3; 430/109.4; 430/111.35

(58) Field of Classification Search
USPC ..... 430/108.8, 108.3, 108.6, 108.7, 109.4, 430/111.32, 111.35
See application file for complete search history.

(56) References Cited

U.S. PATENT DOCUMENTS

| | | | | |
|---|---|---|---|---|
| 5,879,849 | A * | 3/1999 | Sawada et al. | 430/108.7 |
| 7,244,539 | B2 * | 7/2007 | Baba et al. | 430/111.35 |
| 7,356,281 | B2 * | 4/2008 | Miyakawa et al. | 399/111 |
| 2006/0204879 | A1 * | 9/2006 | Anno et al. | 430/108.6 |
| 2007/0218387 | A1 * | 9/2007 | Ishii et al. | 430/108.7 |
| 2008/0096116 | A1 * | 4/2008 | Utsumi et al. | 430/48 |
| 2009/0111042 | A1 | 4/2009 | Kiyono et al. | |
| 2010/0272471 | A1 * | 10/2010 | Yang et al. | 399/222 |

FOREIGN PATENT DOCUMENTS

| | | | |
|---|---|---|---|
| CN | 1993654 | A | 7/2007 |
| CN | 101424894 | A | 5/2009 |
| JP | A-2003-295503 | | 10/2003 |
| JP | A-2007-279400 | | 10/2007 |

OTHER PUBLICATIONS

Mar. 1, 2013 Office Action issued in Chinese Application No. 201010288542.5 (with translation).

* cited by examiner

*Primary Examiner* — Jonathan Jelsma
(74) *Attorney, Agent, or Firm* — Oliff & Berridge, PLC

(57) ABSTRACT

The invention provides a toner for developing an electrostatic image including toner particles having a shape factor SF1 of 110 or more and including a binder resin, and particles of an external additive that adhere to the toner particles, wherein the particles of the external additive including first particles, and second particles which are adhered to the first particles and have a primary particle size of 0.2 times to 0.5 times as large as that of the first particles, and in an image obtained by observing the particles of the external additive with a microscope, when the projection surface area of the first particle is defined as $S_1$ and the total of the projection surface areas of the second particles which are not hidden by the first particle is defined as $S_2$, S2 being from 0.1 times to 0.5 times as large as $S_1$.

18 Claims, 3 Drawing Sheets

TONER FOR DEVELOPING ELECTROSTATIC CHARGE IMAGE, ELECTROSTATIC CHARGE IMAGE DEVELOPER, TONER CARTRIDGE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2010-063226 filed on Mar. 18, 2010.

BACKGROUND

1. Technical Field

The invention relates to a toner for developing an electrostatic charge image, an electrostatic charge image developer, a toner cartridge, a process cartridge and an image forming apparatus.

2. Related Art

It is noted that a toner wherein the number average particle size of inorganic particles is from 80 nm to 150 nm, an average valley depth of the toner particles measured by a scanning probe microscope is from 120 nm to 200 nm, and an average valley depth of the toner particles and an average interval of irregularity in an X direction have a specific relationship.

SUMMARY

According to an aspect of the present invention, there is provided a toner for developing an electrostatic charge, image comprising toner particles having a shape factor SF1 of 110 or more and comprising a binder resin, and particles of an external additive that adhere to the toner particles, the particles of the external additive comprise first particles, and second particles which are adhered to the first particles and have a primary particle size of 0.2 times to 0.5 times as large as that of the first particles, and in an image obtained by observing the particles of the external additive with a microscope, when the projection surface area of the first particle is defined as $S_1$ and the total of the projection surface areas of the second particles which are not hidden by the first particle is defined as $S_2$, S2 being from 0.1 times to 0.5 times as large as $S_1$.

BRIEF DESCRIPTION OF THE DRAWINGS

Exemplary embodiments of the present invention will be described in detail, based on the following figures, wherein.

DETAILED DESCRIPTION

Hereinafter the toner for developing an electrostatic charge image, electrostatic charge image developer, toner cartridge, process cartridge and image forming apparatus of the invention are explained in detail.

<Toner for Developing an Electrostatic Charge Image>

The toner for developing an electrostatic charge image of the present exemplary embodiment (hereinafter simply referred to as "toner") is constituted by including toner particles having a shape factor SF1 of 110 or more and including a binder resin, and external additive particles which are adhered to the toner particles.

The external additive particles are constituted by including first particles, and second particles which are adhered to the first particles and have a primary particle size of from 0.2 times to 0.5 times of that of the first particles, and in an image obtained by observing the particles of the external additive with a microscope, when the projection surface area of the first particles is defined as $S_1$, and the total of the projection surface areas of the second particles which are not hidden by the first particle is defined as $S_2$, S2 being from 0.1 times to 0.5 times as large as $S_1$.

Hereinafter the ratio of the total of the projection surface areas of the second particles which are not hidden by the first particles, $S_2$, to the projection surface area of the first particles, $S_1$ (value of $S_2/S_1$) is sometimes referred to as "surface area ratio".

Figure 1:
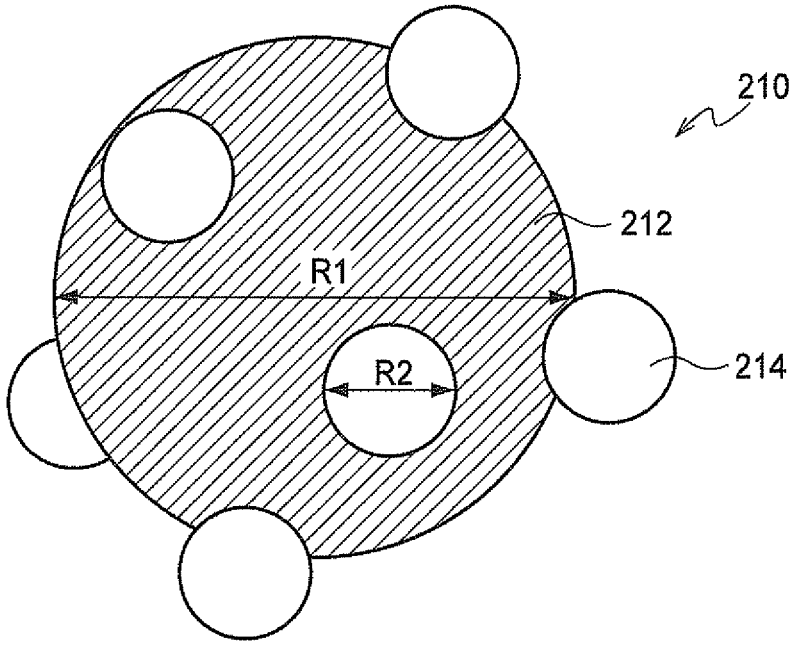
FIG. 1 is a schematic drawing which shows an example of the external additive particles included in the toner of the present exemplary embodiment.

A schematic drawing which shows an example of the external additive particle included in the toner of the present exemplary embodiment is shown in FIG. 1. Furthermore, a schematic drawing which shows another example of the external additive particle included in the toner of the present exemplary embodiment is shown in FIG. 2.

External additive particle 210 as shown in FIG. 1 is constituted by, for example, a first particle 212 and plural second particles 214 that adhere to the first particle 212. In the external additive particle 210 of FIG. 1, FIG. 1 shows that at least 6 second particles 214 having the same primary particle size are adhered to the surface of the first particle 212. Furthermore, the primary particle size of the second particles 214 (R2 as shown in FIG. 1) is from 0.2 times to 0.5 times as large as the primary particle size of the first particle 212 (R1 as shown in FIG. 1). FIG. 1 shows an example of the external additive particle 210 wherein all R2s are 0.25 times as large as R1.

Since the first particle 212 and second particles 214 are all spherical in the external additive particle 210 in FIG. 1, the projection surface area $S_1$ of the first particle 212 is the value of the surface area of a circle having a diameter of R1. Furthermore, in the external additive particle 210 of FIG. 1, the second particles 214 which are not hidden by the first particle 212 are 5 particles (namely, a part of one of the second particles 214 shown in FIG. 1 is hidden by the first particle 212). Therefore, the total of the projection surface areas of the second particles 214, $S_2$, is a value which is 5 times larger than the surface area of the circle having a diameter of R2. Furthermore, since all R2s are 0.25 times as large as R1 in the external additive particle 210 as mentioned above, the surface area ratio ($S_2/S_1$) becomes 0.31 times (i.e., in the range of from 0.1 times to 0.5 times).

Figure 2:
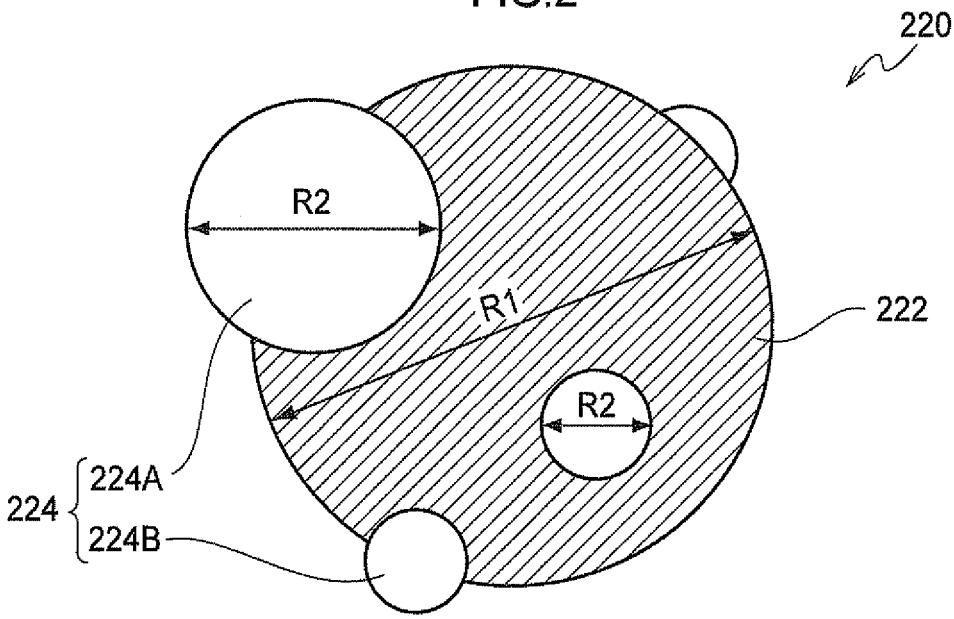
FIG. 2 is a schematic drawing which shows another example of the external additive particles included in the toner of the present exemplary embodiment.

On the other hand, similarly to the external additive particle 210 of FIG. 1, the external additive particle 220 shown in FIG. 2 is constituted by a first particle 222 and plural second particles 224 which are adhered to the first particle 222. However, the second particles 224 are constituted by including two kinds of particles having different primary particle sizes (a second particle 224A and a second particle 2248). Specifically, for example, the second particle 224A which have a larger particle size than that of the second particle 214 in FIG. 1 and second particles 224B which have a smaller particle size than that of the second particle 214 are included. Meanwhile, FIG. 2 shows an example of external additive particle 220 wherein the primary particle size R2 of the second particles 224A is 0.5 times as large as R1 and the primary particle size R2 of the second particle 224B is 0.2 times as large as R1.

Since all of the first particle 222 and second particles 224 are spherical also in the external additive particle 220 of FIG. 2, the projection surface area $S_1$ of the first particle 222 is the value of the surface area of a circle having a diameter of R1. Furthermore, since the second particles 224 which are not hidden by the first particle 222 are one second particle 224A and two second particles 224B (namely, a part of one second particle 224B shown in FIG. 2 is hidden by the first particle 222), the total of the projection surface areas of the second particles 224, $S_2$, is the total value of the surface areas of those circles. In addition, as mentioned above, since R2 of the second particle 224A is 0.5 times as large as R1 and R2 of the second particles 224B is 0.2 times as large as R1 in the external additive particles 220 as mentioned above, the surface area ratio ($S_2/S_1$) becomes 0.33 (i.e., in the range of from 0.1 times to 0.5 times).

Meanwhile, although the external additive particle 220 in FIG. 2 includes a smaller number of the second particles 224 than that of the external additive particles 210 in FIG. 1, the external additive particle 220 has a larger value of the surface area ratio since it includes the second particle 224A having large R2. Namely, in the external additive particles having a value of the surface area ratio in the above-mentioned range, it is considered that an embodiment including the second particles having a larger particle size tends to include second particles which are adhered to the first particles, as compared to an embodiment including only the second particles having a small particle size.

Meanwhile, the external additive particles used for the toner of the present exemplary embodiment are not limited to the above-mentioned embodiment so long as they have a surface area ratio within the above-mentioned range. For example, the number of the second particles included in one external additive particle may be one or plural. Furthermore, as mentioned above, the primary particle size of the second particles may be only one kind or two or more kinds. In addition, although the embodiments wherein the first particles and second particles are spherical particles are explained in FIGS. 1 and 2, the particles are not limited to them so long they have a surface area ratio in the above-mentioned range. For example, individual particle may have irregularity or deformed morphology. Hereinafter an explanation is sometimes made with abbreviating the symbols.

Since the toner of the present exemplary embodiment includes the above-mentioned external additive particles, and toner particles having a shape factor SF1 in the above-mentioned range, decrease in the transfer efficiency is suppressed as compared to the case when the surface area ratio of the external additive particles is out of the above-mentioned range. Although the reason is not clear, it is presumed as follows.

For example, when formation of images by an output at a low area coverage, namely, images having a small ratio of the surface area of the image portion (for example, the ratio of the surface area of the image portion to the total of the surface area of the image portion and the surface area of the non-image portion is 1% or less) is successively continued, the toner in the developing unit receives a mechanical stress by stirring. In such case, when a toner to which external additive particles have been externally added so as to improve the transfer efficiency is used, the external additive particles transfer on the surfaces of the toner particles due to the above-mentioned stress. Specifically, it is considered that transfer of the external additive particles occurs easily when external additive particles having a large particle size are used so as to improve the spacer effect of the external additive particles as compared to the case when external additive particles having a small particle size are used.

Furthermore, it is considered that, since the surfaces of the toner particles have concave portions, when toner particles having a shape factor SF1 of 110 or more are used aiming at improving cleaning property and improving transfer efficiency, the external additive particles transferred due to the above-mentioned stress enter concave portions on the toner particles.

It is considered that, when the external additive particles enter the concave portions on the toner particles, the external additive particles are buried in the concave portions on the toner particles and thus cannot act as spacers, whereby the transfer efficiency is decreased.

On the other hand, in the present exemplary embodiment, the external additive particles are constituted by including the above-mentioned first particles and second particles, and the surface area ratio is in the above-mentioned range. Therefore, the forms of the entire external additive particles are distorted and the forms make the particles difficult to roll, whereby the second particles adhered to the first particles inhibit burial in the concave portions. Therefore, it is considered that the spacer effect of the external additive particles is maintained, whereby decrease in the transfer efficiency is suppressed.

Namely, in the present exemplary embodiment, the above-mentioned burial is suppressed more easily and decrease in the above-mentioned transfer efficiency is more suppressed as compared to the case when the second particles adhered to the first particles are too little so that the above-mentioned burial inhibiting effect is difficult to be obtained, for example, in the case where the surface area ratio is smaller than the above-mentioned range. Furthermore, it is considered that the above-mentioned burial is more suppressed since the particles are difficult to roll and thus the decrease in the above-mentioned transfer efficiency is suppressed as compared to the case where the second particles adhered to the first particles are too much and thus the external additive particles show sphere-like behavior as a whole, for example, in the case where the surface area ratio is higher than the above-mentioned range.

The primary particle size of the above-mentioned first particles is obtained by, for example, analyzing as follows an image obtained by observing the external additive particles using a scanning electron microscope (SEM) by an image analyzing apparatus.

Specifically, for example, an optical microscope image obtained for one external additive particle diffused on the surface of a slide glass is imported in a LUZEX image analyzer via a video camera. The outer frame is extracted from the image with respect to the circular particle having the maximum diameter, and the distance from the center is defined as the particle size of the first particles.

In addition, also in the case when the primary particle size of the first particles is measured for the external additive particles adhered to the toner particles is measured, an image obtained by observing the external additive on the toner surface by a scanning electron microscope (SEM) is imported in a LUZEX image analyzer, the outer frame is extracted from the image with respect to the circular particle having the maximum diameter, and the distance from the center is defined as the particle size of the first particles.

Furthermore, the primary particle size of the second particles is also obtained by a similar method to that for the above-mentioned primary particle size of the first particles. Then, in one external additive particle, among the particles adhered to the first particle, the particles having a primary particle size of from 0.2 times to 0.5 times of the primary particle size of the first particle to which the particles are adhered are defined as second particles.

Meanwhile, when the value of the primary particle size in the first particles is to be discussed with respect to the external additive included in the toner, a value obtained by averaging the primary particle sizes of the first particles obtained for 100 external additive particles by the above-mentioned method (hereinafter the value of the primary particle size of the first particles obtained by averaging is sometimes referred to as "$R^1$ (nm)") is used.

In the method for obtaining the surface area ratio, for example, the image obtained by observing one external additive particle by a scanning electron microscope (SEM) is analyzed by an image analyzer as in the measurement of the above-mentioned primary particle size, the projection surface area of the first particles, $S_1$, and the projection surface area of the second particles which are not hidden by the first particles, $S_2$, are obtained, and the ratio thereof ($S_2/S_1$) is calculated. Specifically, an optical microscope image obtained for one external additive particle diffused on the surface of a slide glass is imported in a LUZEX image analyzer via a video camera, and the ratio of the above-mentioned projection surface areas is obtained for one external additive particle. Meanwhile, when the value of the "surface area ratio" is discussed with respect to the external additive included in the toner, a value obtained by obtaining the ratio of the above-mentioned projection surface areas ($S_2/S_1$) for 100 external additive particles and averaging the ratio is used.

Furthermore, the projection surface area $S_1$ of the above-mentioned first particles is a value including the areas overlapping with the second particles. For example, when the outer frame of the first particle is hidden by the second particles, similarly to the case where the particle size of the above-mentioned first particles is measured, an image obtained by observation using a scanning electron microscope (SEM) is imported in a LUZEX image analyzer and the outer frame of the first particle is obtained from the image by extracting a frame with respect to the circular particle having the maximum diameter, and the projection surface area including the hidden parts is obtained.

In the present exemplary embodiment, the above-mentioned surface area ratio is from 0.1 times to 0.5 times as mentioned above, preferably from 0.2 times to 0.5 times, and more preferably from 0.3 times to 0.5 times.

The above-mentioned shape factor SF1 is quantified by, for example, analyzing a microscope image or scanning electron microscope image by an image analyzer. Specifically, for example, the shape factor SF1 is measured by first importing an optical microscope image of the toner distributed on a slide glass into a LUZEX image analyzer via a video camera, calculating SF1 of the following formula with respect to 50 or more toner particles and obtaining the average value.

Formula: $SF1=(ML^2/A)\times(\pi/4)\times100$

Wherein ML is the absolute maximum length of the particle, and A is the projection surface area of the particle.

In the present exemplary embodiment, the shape factor SF1 of the toner particles is 110 or more, preferably from 110 to 150, more preferably from 110 to 140.

In the present exemplary embodiment, the above-mentioned $R^1$ (nm) is preferably from 80 to 500 nm. Since $R^1$ (nm) is in the above-mentioned range, the transfer efficiency is more improved as compared to the case when $R^1$ (nm) is out of the above-mentioned range. The reason is considered that, when $R^1$ (nm) is in the above-mentioned range, the spacer effect of the external additive particles is higher than that in the case when $R^1$ (nm) is smaller than the above-mentioned range, whereby detachment of the external additive particles from the toner particles is more suppressed than the case when $R^1$ (nm) is larger than the above-mentioned range.

The above-mentioned $R^1$ (nm) in the present exemplary embodiment is more preferably from 100 nm to 400 nm, further preferably from 150 nm to 300 nm.

In the present exemplary embodiment, it is preferable that the second particles include particles having a primary particle size from 0.35 times to 0.5 times as large as the primary particle size of the first particles (hereinafter sometimes referred to as "specific particle size particles"). Meanwhile, among the second particles 214 and 224 included in the external additive particles 210 and 220 described in FIGS. 1 and 2, the second particles 224A correspond to the above-mentioned specific particle size particles.

In addition, also in the embodiment in which the specific particle size particles are included, the second particles may be one specific particle size particle or plural specific particle size particles, or may include the specific particle size particles and other second particles, so long as the primary particle size and surface area ratio of the second particles satisfy the above-mentioned condition.

In the present exemplary embodiment, since the second particles include the specific particle size particles as mentioned above, decrease in the transfer efficiency due to that the toner receives a mechanical stress and the external additive particles are buried on the toner particles is more suppressed as compared to the case where the specific particle size particles are not included. Although the reason is not clear, it is considered that, in the external additive particles in which the primary particle size and surface area ratio of the second particles satisfy the above-mentioned condition, the second particles are unevenly distributed more easily and the forms of entire external additive particles are distorted in the external additive particles including the specific particle size particles (for example, the external additive particle 220 as shown in FIG. 2) as compared to the case where the specific particle size particles are not included (for example, the external additive particle 210 as shown in FIG. 1). Therefore, it is presumed that the external additive particles including the specific particle size particles are more difficult to roll and are difficult to be close-packed even they enter the concave portions on the toner particles, and thus they easily come out of the concave portions, whereby the decrease in the transfer efficiency is suppressed.

In addition, as mentioned above, the primary particle size of the specific particle size particles is preferably from 0.35 times to 0.5 times, more preferably from 0.4 times to 0.5 times of the primary particle size of the first particles.

Hereinafter, the components of the toner according to the present exemplary embodiment are explained.

The toner of the present exemplary embodiment includes at least toner particles and external additive particles. Furthermore, the external additive particles include at least first particles and second particles, and may include other components where necessary. Specifically, the external additive particles may have the above-mentioned surface area ratio in the second particles having a primary particle size of from 0.2 times to 0.5 times as large as the primary particle size of the first particles within the above-mentioned range. For example, other particles (for example, particles having a primary particle size of less than 0.2 times as large as the primary particle size of the first particles, or particles having a primary particle size of more than 0.5 times as large as the primary particle size of the first particles) may adhere to the first particles besides the second particles.

—External Additive Particles—

Examples of the first particles may include, for example, inorganic oxide particles such as silicon oxide, aluminum oxide, zinc oxide, titanium oxide, tin oxide and iron oxide. Although a shape factor SF1 for the first particles is not specifically limited, it may be, for example, in the range of from 100 to 130. As the method for measuring the shape factor SF1 in the first particles, for example, the same method as the method for measuring the shape factor SF1 in the toner particles is used.

Examples of the second particles may include those similar to the specific examples of the first particles.

The first particles and second particles may be of the same kind or different kinds. Furthermore, the second particles may be of one kind or plural kinds.

—Production Method of External Additive Particles—

Examples of the method for producing the external additive particles as mentioned above may include, for example, a method including preparing first particles and second particles separately and adhering the second particles to the surfaces of the first particles, and the like.

The method for producing the first particles is not specifically limited, and is selected according to materials to be used. For example, in the case when the first particles are inorganic oxide particles, specific examples may include a sol-gel method, burning method and the like. Furthermore, in the case when first particles and second particles are prepared separately and adhered, the method for producing the second particles is similar to method for producing the first particles.

As the method including producing first particles and second particles separately and adhering the second particles to the surfaces of the first particles, for example, a method including hydrothermal-treating a dispersion liquid or sol of silica under a high temperature may be used.

Examples of the method for regulating the primary particle size of the first particles and the primary particle size of the second particles may include, for example, when a sol-gel method is used, a method including adjusting the particle size of the sol-gel particles used for first particles and second particles. The particle size of the sol-gel silica particles may be freely controlled by hydrolysis, the weight ratio of alkoxysilane, ammonia, alcohol and water in the polycondensation step, reaction temperature, stirring velocity and supplying velocity in the sol-gel method. Specifically, tetramethoxysilane is added dropwise in the presence of water and an alcohol using an aqueous ammonia as a catalyst while a temperature is applied, and the mixture is stirred. Then, the silica sol suspension liquid obtained by the reaction is separated into a wet silica gel, alcohol and aqueous ammonia by centrifugation.

Furthermore, examples of the above-mentioned method for controlling the above-mentioned surface area ratio of the external additive particles may include, for example, a method including adjusting the concentration of the second particles with respect to the first particles, while controlling the primary particle sizes of first particles and second particles by the above-mentioned method.

—Toner Particles—

Next, the toner particles are explained.

The toner particles include at least a binder resin, and may be constituted by including a colorant, a release agent, other additives and the like as necessary.

The binder resin is explained.

It is preferable that the binder resin is used in the range of from 50% by weight to 90% by weight among the components which constitute the toner particles.

Examples of the binder resin may include known resin materials, and a polyester resin is specifically desirable. The polyester resin is mainly one obtained by polycondensation of a polycarboxylic acid and a polyhydric alcohol.

The polyester resin is preferably produced by condensation reaction of the above-mentioned polyhydric alcohol and polycarboxylic acid according to a conventional method. For example, the polyester resin is preferably produced by putting a polyhydric alcohol and a polycarboxylic acid, and a catalyst where necessary, into a reaction container equipped with a thermometer, a stirrer and a falling condenser, heating the mixture at from 150° C. to 250° C. in the presence of inert gas (nitrogen gas and the like), continuously removing by-produced low molecular compound out of the reaction system, quenching the reaction at the time when the acid value reaches a specific value, and cooling to give an objective reactant.

The binder resin has a weight average molecular weight (Mw) of, preferably from 5000 to 1000000, more preferably from 7,000 to 500,000, a number average molecular weight (Mn) of preferably from 2,000 to 10,000, and a molecular weight distribution Mw/Mn of preferably from 1.5 to 100, more preferably from 2 to 60, according to a molecular weight measurement by gel permeation chromatography (GPC) of components being soluble in tetrahydrofuran (THF).

The weight average molecular weight is obtained by measuring a THF-soluble material in a THF solvent using GPC (trade name: HLC-8120, manufactured by Tosoh Corporation), and a column (trade name: TSKGEL SUPER HM-M (15 cm), manufactured by Tosoh Corporation), and calculating the molecular weight by using a molecular weight calibration curve prepared by a monodispersed polystyrene standard sample.

The glass transition temperature of the binder resin is preferably from 35° C. to 100° C., more preferably from 50° C. to 80° C.

The glass transition temperature of the binder resin is obtained as the peak temperature of the endothermic peak obtained by the above-mentioned differential scanning calorimetry (DSC).

The softening point of the binder resin is preferably in the range of from 80° C. to 130° C., more preferably in the range of from 90° C. to 120° C.

The softening point of the binder resin is measured by obtaining the intermediate temperature between the melting-initiating temperature and melting-terminating temperature in a flow tester (trade name: CFT-500C, manufactured by Shimadzu Corporation) under the condition of preheating: 80° C./300 sec, plunger pressure: 0.980665 MPa, die size: 1 mmϕ×1 mm, and temperature raising velocity: 3.0° C./min.

The colorant is explained.

The colorant may be used in the range of from 2% by weight to 15% by weight, preferably in the range of from 3% by weight to 10% by weight of the components which constitute the toner particles.

Examples of the colorant may include known organic or inorganic pigments, dyes, or oil-soluble dyes.

Examples of black pigments may include carbon black, magnetic powder and the like.

Examples of yellow pigment may include Hansa Yellow, Hansa Yellow 10G, Bendizine Yellow G, Bendizine Yellow GR, Threne Yellow, Quinoline Yellow, Permanent Yellow NCG and the like.

Examples of red pigment may include red iron oxide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eoxine Red, Alizarin Lake and the like.

Examples of blue pigment may include Prussian Blue, Cobalt Blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green, Malachite Green Oxalate and the like.

Furthermore, these colorants may be mixed, or used in the form of a solid solution.

Next, the release agent is explained.

The release agent may be used in the range from 1% by weight to 10% by weight, more preferably in the range from 2% by weight to 8% by weight of the components which constitute the toner particles.

As a release agent, a material having a main endothermic peak temperature as measured according to ASTMD3418-8 in the range from 50° C. to 140° C. is preferable.

For the measurement of the main endothermic peak temperature, for example, DSC-7 manufactured by Perkin Elmer is used. For the correction of the temperature at the detection portion of this apparatus, melting temperatures of indium and zinc are used, and for the correction of the calorie, the melting heat of indium is used. The sample is measured by using an aluminum pan and setting an empty pan as a control at a temperature raising velocity of 10° C./min.

The viscosity $\eta 1$ of the release agent at 160° C. is preferably in the range of from 20 cps to 600 cps.

Specific examples of the release agent may include low molecular weight polyolefins such as polyethylene, polypropylene and polybutene; silicones which show a softening point upon heating; aliphatic acid amides such as oleic acid amide, erucic acid amide, ricinoleic acid amide and stearic acid amide; vegetable waxes such as carnauba wax, rice wax, candelilla wax, Japan wax and jojoba oil; animal waxes such as bees wax; mineral and petrolatum waxes such as Montan wax, ozokerite, ceresin, paraffin wax, microcrystalline wax and Fischer-Tropsch wax, and modified products thereof.

Additional additives are explained.

Examples of the additional additives may include various components such as an internal additive, a charge controlling agent, an inorganic powder (inorganic particles) and organic particles.

Examples of the internal additive may include metals such as ferrite, magnetite, reduced iron, cobalt, nickel and manganese, alloys, and magnetic materials of compounds including these metals, and the like.

Examples of the inorganic particles may include known inorganic particles such as silicon oxide particles, titanium oxide particles, alumina particles and cerium oxide particles, and particles obtained by hydrophobization treatment of the surfaces of these particles. These inorganic particles may be subjected to various surface treatments, and for example, those subjected to a surface treatment using a silane-based coupling agent, a titanium-based coupling agent, a silicone oil or the like are preferable.

Next, the property of the toner particles is explained.

The volume average particle size of the toner particles is preferably in the range of from 4 μm to 9 μm. The volume average particle size is measured by using MULTISIZER II (trade name, manufactured by Beckman-Coulter) at an aperture diameter of 50 μm. At this time, the measurement is carried out after dispersing the toner in an aqueous electrolyte solution (aqueous solution of ISOTON) and dispersing by ultrasonic for 30 seconds or more.

Next, the method for producing the toner of the present exemplary embodiment is explained.

First, the toner particles may be produced by any of dry production methods (for example, kneading-pulverization method and the like), and wet production methods (for example, aggregation method, suspension polymerization method, dissolution suspension granulation method, dissolution suspension method, dissolution emulsification aggregation method and the like). These production methods are not specifically limited, and a well-known production method is adopted.

The toner of the present exemplary embodiment is produced by, for example, adding an external additive to the obtained toner particles and mixing. The mixing is preferably carried out by using, for example, a V blender, a Henschel mixer, a Loedige mixer or the like. Furthermore, where necessary, coarse particles of the toner may be removed by using an oscillation sieve, a wind power sieve or the like.

The externally-added amount of the above-mentioned oil-treated particles is, for example, preferably from 0.1 parts by weight to 3.0 parts by weight, more preferably from 0.2 parts by weight to 2.5 parts by weight, further more preferably from 0.3 parts by weight to 2.0 parts by weight, with respect to 100 parts by weight of the toner particles.

In addition, other external additive other than the above-mentioned oil-treated particles may be used as the external additive. Examples of other external additive may include, for example, well-known ones such as inorganic particles and organic particles. Specific examples of the inorganic particles may include any particles which are generally used as an external additive for toner surfaces such as alumina, titania, calcium carbonate, magnesium carbonate, calcium triphosphate and cerium oxide, and examples of the organic particles may include any particles which are generally used as external additives on the toner surface such as vinyl-based resins, polyester resins, silicone resins and fluorine-based resins.

<Electrostatic Charge Image Developer>

The electrostatic charge image developer of the present exemplary embodiment includes at least the toner of the present exemplary embodiment.

The electrostatic charge image developer of the present exemplary embodiment may be a one-component developing agent including only the toner for developing an electrostatic charge image of the present exemplary embodiment, or a two-component developing agent mixed with a carrier.

The carrier is not specifically limited, and known carriers may be exemplified. Examples of the carrier may include a resin-coat carrier, a magnetic dispersion carrier, a resin-dispersed carrier and the like.

The mixing ratio (weight ratio) of the toner of the present exemplary embodiment to the carrier in the above-mentioned two-component developing agent is preferably in the range of toner:carrier being about 1:100 to 30:100, more preferably in the range of about 3:100 to 20:100.

<Image Forming Apparatus>

Next, the image forming apparatus of the present exemplary embodiment is explained.

The image forming apparatus of the present exemplary embodiment has a latent image holding member, a charging unit which charges the surface of the latent image holding member, an electrostatic latent image forming unit which forms an electrostatic latent image on the surface of the latent image holding member, a developing unit which houses the electrostatic charge image developer, which develops the electrostatic latent image formed on the surface of the latent image holding member by the electrostatic charge image developer to form a toner image, and a transfer unit which transfers the toner image formed on the surface of the latent image holding member on an object, and may have a fixing unit for fixing the toner image transferred on the object, a toner removal unit for removing the residual toner remaining on the surface of the latent image holding member after transfer, and the like where necessary. Furthermore, the electrostatic charge image developer of the above-mentioned present exemplary embodiment is applied as the electrostatic charge image developer.

In the image forming apparatus of the present exemplary embodiment, for example, the part including the developing unit may have a cartridge structure (process cartridge) which is attachable to and detachable from the image forming apparatus, and as the process cartridge, a process cartridge including the developing unit in which the electrostatic charge image developer of the present exemplary embodiment is housed is preferably used. Furthermore, in this image forming apparatus, for example, a part for housing a supplemental electrostatic charge image developer may have a cartridge structure (toner cartridge) which is attachable to and detachable from the image forming apparatus, and as the toner cartridge, a toner cartridge which houses the electrostatic charge image developer of the present exemplary embodiment is preferably adopted.

Hereinafter an example of the image forming apparatus of the present exemplary embodiment is shown, but the invention is not limited to this. The main parts as shown in the drawings are explained, and explanations for other parts are omitted.

Figure 3:
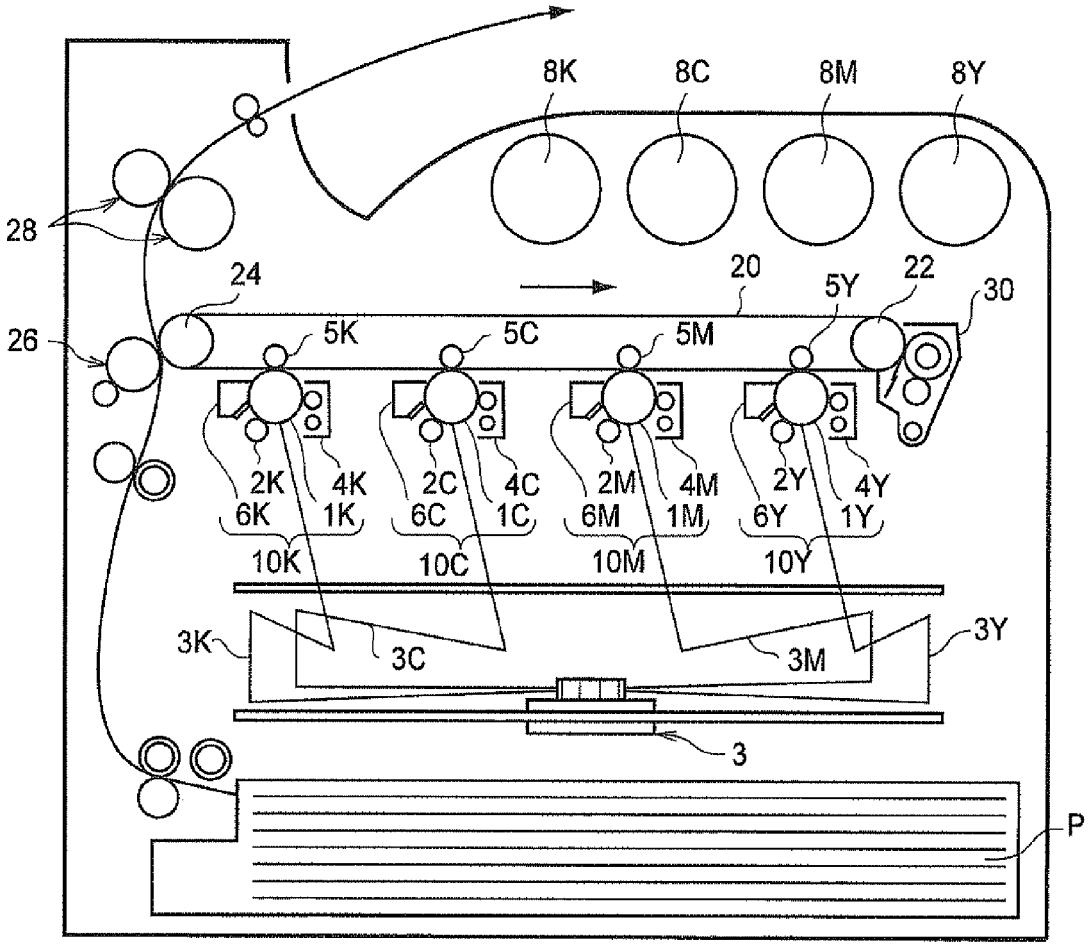
FIG. 3 is a schematic constitutional drawing which shows an example of the image forming apparatus of the present exemplary embodiment.

FIG. 3 is a schematic constitutional drawing which shows an example of the 4-drum tandem image forming apparatus of the present exemplary embodiment. The image forming apparatus as shown in FIG. 3 includes first to fourth image forming units 10Y, 10M, 10C and 10K (image forming unit) of an electrophotographic system which output the images of the colors of yellow (Y), magenta (M), cyan (C) and black (K) based on color-separated image data. These image forming units (hereinafter simply referred to as "units") 10Y, 10M, 10C and 10K are arranged in parallel each other at predetermined intervals in the vertical direction. These units 10Y, 10M, 10C and 10K may be process cartridges which are attachable to and detachable from the main body of the image forming apparatus.

Above the units 10Y, 10M, 10C and 10K on the upper side of the drawing, an intermediate transfer belt 20 as an intermediate transfer body is running through the units. The intermediate transfer belt 20 is wound around a driving roller 22 and a supporting roller 24 which is contacting with the inner surface of the intermediate transfer belt 20, which are disposed aparting from each other in the direction from the left to right of the drawing, and runs in the direction from the first unit 10Y to the fourth unit 10K. The supporting roller 24 is biased by a spring and the like (not depicted) in the direction aparting from the driving roller 22, whereby a predetermined tension is provided to the intermediate transfer belt 20 which is wound around both rollers. An intermediate transfer body cleaning apparatus 30 is disposed opposing to the driving roller 22 on the side surface of the image holding member of the intermediate transfer belt 20.

Toners of 4 colors of yellow, magenta, cyan and black which are housed in toner cartridges 8Y, 8M, 8C and 8K are respectively supplied to developing apparatuses (developing unit) 4Y, 4M, 4C and 4K of the units 10Y, 10M, 10C and 10K.

Since the above-mentioned first to fourth units 10Y, 10M, 10C and 10K have similar constitutions, the first unit 10Y which forms an yellow image, which is disposed on the upperstream side of the direction of running of the intermediate transfer belt, is explained here as a representative example. The explanations on the second to fourth units 10M, 10C and 10K are omitted by providing reference symbols provided with magenta (M), cyan (C) and black (K) instead of yellow (Y) to parts similar to the first unit 10Y.

The first unit 10Y has a photoreceptor 1Y (latent image holding member) which acts as a latent image holding member. A charging roller 2Y (charging unit) which charges the surface of the photoreceptor 1Y to a predetermined electrical potential, an exposing apparatus 3 (electrostatic latent image forming unit) which exposes the charged surface by a laser beam 3Y based on a color-separated image signal to form an electrostatic latent image (electrostatic latent image forming unit), a developing apparatus 4Y (developing unit) which supplies the charged toner to the electrostatic latent image to develop an electrostatic latent image, a primary transfer roller 5Y (primary transfer unit) which transfers the developed toner image on the intermediate transfer belt 20, and a photoreceptor cleaning apparatus 6Y (toner removing unit) which removes the toner remaining on the surface of the photoreceptor 1Y after the primary transfer, are disposed in this order around the photoreceptor 1Y.

The primary transfer roller 5Y is disposed on the inner side of the intermediate transfer belt 20 at the position opposing to the photoreceptor 1Y. Furthermore, bias current sources (not depicted) for applying a primary transfer bias are connected respectively to the primary transfer rollers 5Y, 5M, 5C and 5K. Each bias current source varies the transfer bias applied to each primary transfer roller by control by a control portion (not depicted).

Hereinafter an operation for forming an yellow image in the first unit 10Y is explained. First, prior to the operation, the surface of the photoreceptor 1Y is charged with an electropotential of about from −600 V to about −800 V by the charging roller 2Y.

The photoreceptor 1Y is formed by laminating a photosensitive layer on an electroconductive (the volume resistance ratio at 20° C.:$1\times10^{-6}$ Ω·cm or less) substrate. This photosensitive layer generally has a high resistance (a resistance similar to that of a general resin), but has a property that, when the laser beam 3Y is irradiated, the specific resistance of the part to which the laser beam is irradiated is varied. Therefore, the laser beam 3Y is output on the surface of the charged photoreceptor 1Y via an exposing apparatus 3 according to the image data for yellow which is sent from a control portion (not depicted). The laser beam 3Y is irradiated to the photosensitive layer on the surface of the photoreceptor 1Y, whereby an electrostatic latent image having a yellow printing pattern is formed on the surface of the photoreceptor 1Y.

The electrostatic latent image is an image formed on the surface of the photoreceptor 1Y by charging, and is so-called a negative latent image, which is formed by that the specific resistance of the part to be irradiated on the photosensitive layer is decreased by the laser beam 3Y, and the charged electron charge on the surface of the photoreceptor 1Y flows whereas the electron charge on the part to which the laser beam 3Y is not irradiated remains.

The electrostatic latent image formed on the photoreceptor 1Y as above is rotated to a predetermined developing position according to running of the photoreceptor 1Y. Then, the electrostatic latent image on the photoreceptor 1Y is visualized as an image (toner image) by the developing apparatus 4Y on this developing position.

The developing apparatus 4Y houses the yellow toner of the present exemplary embodiment. The yellow toner is friction-charged by being stirred in the developing apparatus 4Y, and retained on a developing agent roll (developing agent holding member) with an electron charge having the same polarity (negative polarity) as that of the electron charge charged on the photoreceptor 1Y. Furthermore, the yellow toner electrostatically adheres to the erased latent image portion on the surface of the photoreceptor 1Y when the surface of the photoreceptor 1Y passes through the developing apparatus 4Y, whereby a latent image is developed by the yellow toner. The photoreceptor 1Y on which the yellow toner image has been formed subsequently runs at a predetermined velocity, whereby the toner image developed on the photoreceptor 1Y is carried to a predetermined position for primary transfer.

When the yellow toner image on the photoreceptor 1Y is carried to the primary transfer, a predetermined primary transfer bias is applied on the primary transfer roller 5Y, an electrostatic power which comes from the photoreceptor 1Y toward the primary transfer roller 5Y acts on the toner image, and the toner image on the photoreceptor 1Y is transferred on the intermediate transfer belt 20. The transfer bias applied at this time has a (+) polarity which is opposite to the polarity (−) of the toner, and is controlled to be about +10 μA by, for example, a controlling portion (not depicted) in the first unit 10Y.

On the other hand, the toner remaining on the photoreceptor 1Y is removed and collected by the cleaning apparatus 6Y.

Furthermore, the primary transfer biases applied on the primary transfer rollers 5M, 5C and 5K after the second unit 10M are also controlled in accordance with the first unit.

Thus, the intermediate transfer belt 20 on which the yellow toner image has been transferred at the first unit 10Y is subsequently carried through the second to fourth units 10M, 10C and 10K, whereby toner images having respective colors are superposed and multi-transferred.

The intermediate transfer belt 20 on which the toner images of 4 colors have been multi-transferred through the first to fourth units reaches the secondary transfer portion, which is constituted by the intermediate transfer belt 20, the supporting roller 24 which is contacted with the inner surface of the intermediate transfer belt 20, and the secondary transfer roller (secondary transfer unit) 26 which is disposed on the image retention surface of the intermediate transfer belt 20. On the other hand, recording paper (object) P is fed to the gap at which the secondary transfer roller 26 and the intermediate transfer belt 20 are contacted with a pressure at a predetermined timing via a feeding mechanism, and a predetermined secondary transfer bias is applied to the supporting roller 24. At this time, the applied transfer bias has the same (−) polarity as the polarity (−) of the toner, the electrostatic force which comes from the intermediate transfer belt 20 toward the recording paper P acts on the toner image, whereby the toner image on the intermediate transfer belt 20 is transferred on the recording paper P. The secondary transfer bias at this time is determined by a resistance which is detected by a resistance detecting unit (not depicted) for detecting the resistance of the secondary transfer portion, and is controlled by an electrical voltage.

Then, the recording paper P is sent to a fixing apparatus (fixing unit) 28 and the toner image is heated, whereby the multi-colored toner image is molten and fixed on the recording paper P. The recording paper P on which fixing of the color image has been completed is carried out from an ejection portion, whereby a set of operations for forming a color image is completed.

Although the image forming apparatus exemplified above has a constitution in which the toner image is transferred to the recording paper P via the intermediate transfer belt 20, it is not limited to this constitution, and may have a structure in which a toner image is directly transferred to the recording paper from the photoreceptor.

<Process Cartridge and Toner Cartridge>

Figure 4:
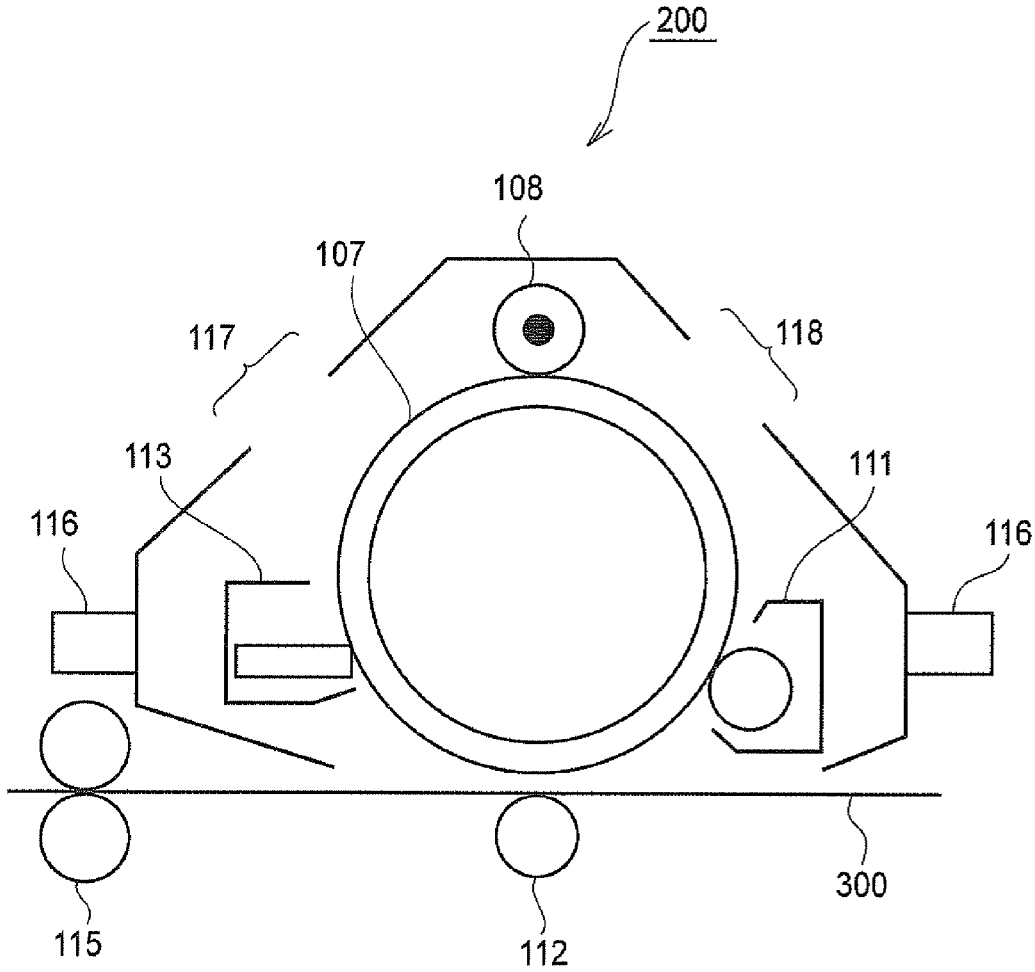
FIG. 4 is a schematic constitutional drawing which shows an example of the process cartridge of the present exemplary embodiment.

FIG. 4 is a schematic constitutional drawing which shows a preferable example of a process cartridge for housing the electrostatic charge image developer of the present exemplary embodiment. The process cartridge 200 is obtained by combining a charging roller 108, a developing apparatus 111, a photoreceptor cleaning apparatus (cleaning unit) 113, an opening for exposure 118 and an opening for erasing exposure 117 with a photoreceptor 107 using an attachment rail 116, and integrating them. In FIG. 4, the symbol 300 shows recording paper (object).

The process cartridge 200 may be attached to or detached from the main body of the image forming apparatus which is constituted by a transfer apparatus 112, a fixing apparatus 115 and other constitutional parts (not depicted), and constitutes image forming apparatus together with the main body of the image forming apparatus.

The process cartridge as shown in FIG. 4 includes a charging roller 108, a developing apparatus 111, a cleaning apparatus (cleaning unit) 113, an opening for exposure 118 and an opening for erasing exposure 117, and these apparatuses may be selectively combined. The process cartridge of the present exemplary embodiment has only to have at least the developing apparatus 111, and may include, besides this, at least one kind selected from the group consisting of the photoreceptor 107, the charging roller 108, the photoreceptor cleaning apparatus (cleaning unit) 113, the opening for exposure 118, and the opening for erasing exposure 117.

Next, the toner cartridge of the present exemplary embodiment is explained. The toner cartridge of the present exemplary embodiment is a toner cartridge which houses at least a toner to be fed to the developing unit disposed in the image forming apparatus, which is attachable to and detachable from the image forming apparatus, wherein the toner is the present exemplary embodiment as mentioned above. The toner cartridge of the present exemplary embodiment has only to have at least the toner, and for example, a developing agent may be housed according to the mechanism of the image forming apparatus.

Therefore, in the image forming apparatus having a constitution in which the toner cartridge is attachable to and detachable from the apparatus, the toner of the present exemplary embodiment is readily supplied to the developing apparatus by utilizing the toner cartridge in which the toner of the present exemplary embodiment is housed.

The image forming apparatus shown in FIG. 3 is an image forming apparatus having a constitution in which the toner cartridges 8Y, 8M, 8C and 8K are attachable to and detachable from the apparatus, and the developing apparatuses 4Y, 4M, 4C and 4K are connected to the toner cartridges corresponding to the respective developing apparatuses (colors) via toner feeding tubes (not depicted). When the toners contained in the toner cartridges are decreased, the toner cartridges are replaced.

EXAMPLES

Hereinafter the present exemplary embodiment is specifically explained in detail with referring to Examples and Comparative Examples, but the present exemplary embodiment should not be limited to these Examples.

[Toner]

<Preparation of Polyester Resin 1>

| Polymerizable monomer | |
|---|---|
| Telephthalic acid | 30 mol % |
| Fumaric acid | 70 mol % |
| Bisphenol A ethyleneoxide 2 mol adduct | 20 mol % |
| Bisphenol A propyleneoxide 2 mol adduct | 80 mol % |

The above-mentioned monomers are charged in a flask of 5 L volume equipped with a stirrer, a nitrogen introduction tube, a temperature sensor and a distillation column, and the temperature is raised to 190° C. for 1 hour. After the reaction system is stirred is confirmed, 1.2 parts by weight of dibutyltin oxide is put in.

The temperature is further raised from that temperature to 240° C. for 6 hours while the water produced is distilled off, and the dehydration condensation reaction is further continued at 240° C. for 3 hours to give a polyester resin 1 having an acid value of 12.0 mg/KOH and a weight average molecular weight of 9700.

<Preparation of Polyester Resin Dispersion Liquid 1>

The obtained polyester resin 1 is transferred to CAVITRON CD1010 (trade name, manufactured by EuroTec) at a velocity of 100 g/min in a melted form.

Diluted aqueous ammonia having a concentration of 0.37% by weight, which is obtained by diluting an agent, aqueous ammonia with ion exchanged water, is put into an aqueous medium tank which is separately prepared, and is transferred to CAVITRON CD1010 (trade name, manufactured by EuroTec) together with the molten form of the above-mentioned amorphous polyester resin 1 at a velocity of 0.1 liter/min while the mixture is heated by a heat exchanger to 120° C.

The CAVITRON is driven under a condition in which the rotary velocity of the rotor is 60 Hz and the pressure is 5 kg/cm$^2$ to obtain a resin dispersion liquid including a polyester resin having an average particle size of 0.16 μm and a solid content of 30 parts by weight (polyester resin dispersion liquid 1).

<Preparation of Colorant Dispersion Liquid>

| Components of colorant dispersion liquid | |
|---|---|
| Cyan pigment (trade name: COPPER PHTHALOCYANINE B 15:3, manufactured by Dainichiseika Color & Chemicals Mfg. Co., Ltd.) | 45 parts by weight |
| Ionic surfactant (trade name: NEOGEN RK, manufactured by Dai-ichi Kogyo Seiyaku Co., Ltd.) | 5 parts by weight |
| Ion exchanged water | 200 parts by weight |

The above-mentioned components for a colorant dispersion liquid are dissolved by mixing and dispersed using a homogenizer (trade name: ULTRA-TURRAX, manufactured by IKA) for 10 minutes to give a colorant dispersion liquid having a center particle size of 168 nm and a solid content of 22.0 parts by weight.

<Preparation of Release Agent Dispersion Liquid>

| Components of release agent dispersion liquid | |
|---|---|
| Paraffin wax (trade name: HNP9, manufactured by Nippon Seiro Co., Ltd., melting point 75° C.) | 45 parts by weight |
| Cationic surfactant (trade name: NEOGEN RK, manufactured by Dai-ichi Kogyo Seiyaku Co., Ltd.) | 5 parts by weight |
| Ion exchanged water | 200 parts by weight |

The above-mentioned components for a release agent dispersion liquid are heated to 95° C., dispersed in ULTRA-TURRAX T50 manufactured by IKA, and then subjected to a dispersing treatment using a pressure-ejection type Gaulin homogenizer to give a release agent dispersion liquid having a center diameter of 200 nm and a solid content of 20.0 parts by weight.

<Preparation of Toner Particles 1>

| Components for toner particles 1 | |
|---|---|
| Polyester resin dispersion liquid 1 | 278.9 parts by weight |
| Colorant dispersion liquid | 27.3 parts by weight |
| Release agent dispersion liquid | 35 parts by weight |

The above-mentioned components for toner particles 1 are dispersed by mixing in a round stainless flask using ULTRA-TURRAXT50. Then, 0.20 part by weight of polyaluminum chloride is added thereto, and dispersing operation is continued in ULTRA-TURRAX. The flask was heated to 48° C. in an oil bath for heating under stirring. The dispersion was retained at 48° C. for 60 minutes, then 70.0 parts by weight of the resin dispersion liquid (polyester resin dispersion liquid 1) is added to the dispersion.

Then, the pH in the system is adjusted to 9.0 with a 0.5 mol/l aqueous solution of sodium hydroxide, the stainless flask is sealed, and the system is heated to 96° C. while the stirring is continued using a magnetic seal and retained for 5 hours.

After the reaction is completed, the reactant is cooled, filtered, washed with ion exchanged water, and subjected to solid-liquid separation by Nutsche suction filtration. The product is dispersed again in 1 L of ion exchanged water of 40° C., and stirred and washed for 15 minutes at 300 rpm.

This is repeated further 5 times, and at the time when the pH of the filtrate reaches 7.5 and the electroconductivity reaches 7.0 μS/cmt, solid-liquid separation is performed using No 5A filter paper by Nutsche suction filtration. Then, vacuum drying is continued for 12 hours to give the toner particles 1.

The particle size at this time is measured by Coulter Multisizer, whereby the volume average particle size is found to be 5.9 μm. Furthermore, it is observed that the shape factor of the particles obtained by a morphology observation using LUZEX is 130.

<Preparation of Toner Particles 2>

The toner particles 2 was prepared in a similar manner to that for the toner particles 1 except that the retention time after heating up to 96° C. is changed to 7 hours. It was observed that the shape factor of the particles obtained by a morphology observation of the toner particles 2 by LUZEX is 115.

<Preparation of Toner Particles 3>

| Components for toner particles 3 | |
|---|---|
| Polyester resin 1 | 85 parts by weight |
| Cyan pigment (trade name: COPPER PHTHALOCYANINE B15:3, manufactured by Dainichiseika Color & Chemicals Mfg. Co., Ltd.) | 5 parts by weight |
| Paraffin wax (trade name: HNP9, manufactured by Nippon Seiro Co., Ltd., melting temperature 75° C.) | 8 parts by weight |
| Hydrophobidized titanium metatitanate | 2 parts by weight |

The above-mentioned three components for the toner particles are pre-mixed using a Henschel mixer, and then kneaded using a biaxial kneader. The obtained kneaded product is subjected to rolling cooling using a water-cooling type cooling conveyer, roughly crushed using a pin crusher, and further crushed with a hammer mill to roughly crush the product to a particle size of about 300 μm. The coarsely crushed product is pulverized in a fluidized bed pulverizer (trade name: AFG400, manufactured by Alpine) and further subjected to separation by a micron separator EJ30 to give toner particles having a volume average particle size of 6.1 μm. At this time, metatitanium acid is continuously fed from the feeding inlet of the fluidized pulverizer AFG400 at a ratio of 1 part by weight with respect to 100 parts by weight of the pulverized product to give the toner particles 3.

Furthermore, it is observed that the shape factor SF1 of the toner particles obtained by morphology observation using LUZEX is 150.

<Preparation of External Additive Particles 1>

The external additive particles 1 are prepared as follows.

First, 60 g of a dispersion liquid of a sol-gel silica having a particle size of 80 nm (silica concentration 30% by weight) and 40 g of a dispersion liquid of a sol-gel silica having a particle size of 40 nm (silica concentration 30% by weight) are added to 200 g of a dispersion liquid of a sol-gel silica having a particle size of 180 nm (silica concentration 30% by weight) which acts as first particles, and subjected to a hydrothermal treatment in an autoclave at 300° C. for 15 hours. The silica sol suspension liquid is separated by centrifugation into a wet silica gel, an alcohol and an aqueous ammonia. A solvent is added to the wet silica gel to prepare a silica sol again, and a hydrophobization treatment agent is added thereto to hydrophobize the surface of the silica. As the hydrophobization treatment agent, a general silane compound may be used. Then, the solvent is removed from the hydrophobization-treated silica sol, and the sol is dried and sieved to give the external additive particles 1.

The surface area ratio, $R^1$ (nm), and the presence or absence and particle size of the specific particle size particles, which are obtained by observing the obtained external additive particles with a microscope, are shown in Table 1.

<Preparation of External Additive Particles 2>

The external additive particles 2 are prepared in a manner similar to that for the external additive particles 1, except that 70 g of a dispersion liquid of a sol-gel silica having a particle size of 60 nm (silica concentration 30% by weight) is used instead of 60 g of the dispersion liquid of a sol-gel silica having a particle size of 80 nm (silica concentration 30% by weight) and 40 g of the dispersion liquid of a sol-gel silica having a particle size of 40 nm (silica concentration 30% by weight).

The surface area ratio, $R^1$ (nm), and the presence or absence and particle size of the specific particle size particles, which are obtained by observing the obtained external additive particles with a microscope, are shown in Table 1.

<Preparation of External Additive Particles 3>

The external additive particles 3 are prepared in a manner similar to that for the external additive particles 1, except that 40 g of a dispersion liquid of a sol-gel silica having a particle size of 60 nm (silica concentration 30% by weight) is used instead of 60 g of the dispersion liquid of a sol-gel silica having a particle size of 80 nm (silica concentration 30% by weight) and 40 g of the dispersion liquid of a sol-gel silica having a particle size of 40 nm (silica concentration 30% by weight).

The surface area ratio, $R^1$ (nm), and the presence or absence and particle size of the specific particle size particles, which are obtained by observing the obtained external additive particles with a microscope, are shown in Table 1.

<Preparation of External Additive Particles 4>

The external additive particles 4 are prepared in a manner similar to that for the external additive particles 1, except that 120 g of a dispersion liquid of a sol-gel silica having a particle size of 60 nm (silica concentration 30% by weight) is used instead of 60 g of the dispersion liquid of a sol-gel silica having a particle size of 80 nm (silica concentration 30% by weight) and 40 g of the dispersion liquid of a sol-gel silica having a particle size of 40 nm (silica concentration 30% by weight).

The surface area ratio, $R^1$ (nm), and the presence or absence and particle size of the specific particle size particles, which are obtained by observing the obtained external additive particles with a microscope, are shown in Table 1.

<Preparation of External Additive Particles 5>

The external additive particles 5 are prepared in a manner similar to that for the external additive particles 1, except that 110 g of a dispersion liquid of a sol-gel silica having a particle size of 30 nm (silica concentration 30% by weight) is added to 200 g of a dispersion liquid of a sol-gel silica having a particle size of 80 nm (silica concentration 30% by weight) which acts as first particles, instead of that 60 g of a dispersion liquid of a sol-gel silica having a particle size of 80 nm (silica concentration 30% by weight) and 40 g of a dispersion liquid of a sol-gel silica having a particle size of 40 nm (silica concentration 30% by weight) are added to 200 g of a dispersion liquid of a sol-gel silica having a particle size of 180 nm (silica concentration 30% by weight) which acts as first particles.

The surface area ratio, $R^1$ (nm), and the presence or absence and particle size of the specific particle size particles, which are obtained by observing the obtained external additive particles with a microscope, are shown in Table 1.

<Preparation of External Additive Particles 6>

The external additive particles 6 are prepared in a manner similar to that for the external additive particles 1, except that 90 g of a dispersion liquid of a sol-gel silica having a particle size of 150 nm (silica concentration 30% by weight) is added to 200 g of a dispersion liquid of a sol-gel silica having a particle size of 450 nm (silica concentration 30% by weight) which acts as first particles, instead of that 60 g of a dispersion liquid of a sol-gel silica having a particle size of 80 nm (silica concentration 30% by weight) and 40 g of a dispersion liquid of a sol-gel silica having a particle size of 40 nm (silica concentration 30% by weight) are added to 200 g of a dispersion liquid of a sol-gel silica having a particle size of 180 nm (silica concentration 30% by weight) which acts as first particles.

The surface area ratio, $R^1$ (nm), and the presence or absence and particle size of the specific particle size particles, which are obtained by observing the obtained external additive particles with a microscope, are shown in Table 1.

<Preparation of External Additive Particles 7>

The external additive particles 7 are prepared in a manner similar to that for the external additive particles 1, except that 100 g of a dispersion liquid of a sol-gel silica having a particle size of 20 nm (silica concentration 30% by weight) is added to 200 g of a dispersion liquid of a sol-gel silica having a particle size of 60 nm (silica concentration 30% by weight) which acts as first particles, instead of that 60 g of a dispersion liquid of a sol-gel silica having a particle size of 80 nm (silica concentration 30% by weight) and 40 g of a dispersion liquid of a sol-gel silica having a particle size of 40 nm (silica concentration 30% by weight) are added to 200 g of a dispersion liquid of a sol-gel silica having a particle size of 180 nm (silica concentration 30% by weight) which acts as first particles.

The surface area ratio, $R^1$ (nm), and the presence or absence and particle size of the specific particle size particles, which are obtained by observing the obtained external additive particles with a microscope, are shown in Table 1.

<Preparation of External Additive Particles 8>

The external additive particles 8 are prepared in a manner similar to that for the external additive particles 1, except that 80 g of a dispersion liquid of a sol-gel silica having a particle size of 180 nm (silica concentration 30% by weight) is added to 200 g of a dispersion liquid of a sol-gel silica having a particle size of 600 nm (silica concentration 30% by weight) which acts as first particles, instead of that 60 g of a dispersion liquid of a sol-gel silica having a particle size of 80 nm (silica concentration 30% by weight) and 40 g of a dispersion liquid of a sol-gel silica having a particle size of 40 nm (silica concentration 30% by weight) are added to 200 g of a dispersion liquid of a sol-gel silica having a particle size of 180 nm (silica concentration 30% by weight) which acts as first particles.

The surface area ratio, $R^1$ (nm), and the presence or absence and particle size of the specific particle size particles, which are obtained by observing the obtained external additive particles with a microscope, are shown in Table 1.

<Preparation of External Additive Particles 9>

The external additive particles 9 are prepared in a manner similar to that for the external additive particles 1, except that 15 g of a dispersion liquid of a sol-gel silica having a particle size of 80 nm (silica concentration 30% by weight) is used instead of 60 g of the dispersion liquid of a sol-gel silica having a particle size of 80 nm (silica concentration 30% by weight) and 40 g of the dispersion liquid of a sol-gel silica having a particle size of 40 nm (silica concentration 30% by weight).

The surface area ratio, $R^1$ (nm), and the presence or absence and particle size of the specific particle size particles, which are obtained by observing the obtained external additive particles with a microscope, are shown in Table 1.

<Preparation of External Additive Particles 10>

The external additive particles 10 are prepared in a manner similar to that for the external additive particles 1, except that 140 g of a dispersion liquid of a sol-gel silica having a particle size of 80 nm (silica concentration 30% by weight) is used instead of 60 g of the dispersion liquid of a sol-gel silica having a particle size of 80 nm (silica concentration 30% by weight) and 40 g of the dispersion liquid of a sol-gel silica having a particle size of 40 nm (silica concentration 30% by weight).

The surface area ratio, $R^1$ (nm), and the presence or absence and particle size of the specific particle size particles, which are obtained by observing the obtained external additive particles with a microscope, are shown in Table 1.

<Preparation of Toner>

100 parts by weight of the toner particles and 0.3 part by weight of the external additive particles are blended in a combination according to Table 1 using a Henschel mixer at a circumference velocity of 32 m/s for 10 minutes. Coarse particles are removed by using a 45 μm mesh sieve to give an external additive toner to which the external additive has been added.

[Preparation of Carrier]

Ferrite particles (manufactured by Powdertech, volume average particle size 35 μm): 100 parts by weight Toluene: 14 parts by weight Perfluorooctylethyl acrylate/methyl methacrylate copolymer (copolymerization ratio=40:60, weight average molecular weight Mw=50,000): 0.8 part by weight Carbon black (trade name: VXC-72, manufactured by Cabot): 0.06 part by weight Crosslinked melamine resin particles (number average particle size; 0.3 μm): 0.15 part by weight Of the above-mentioned components, components other than ferrite particles are dispersed in a stirrer for 10 minutes to prepare a liquid for coating. The liquid for coating and ferrite particles are put into a vacuum degassing kneader and stirred at 60° C. for 30 minutes. Toluene is distilled off by reducing pressure to form resin coatings on the surface of the ferrite particles to prepare a carrier.

[Preparation of Developing Agent]

4 parts by weight of the obtained external additive toner and 96 parts by weight of the carrier are stirred at 40 rpm for 20 minutes using a V-blender and sieved using a 250 μm mesh sieve to prepare a developing agent.

[Evaluation]

The obtained developing agent is evaluated as follows. The result is shown in Table 1.

(Evaluation of Image Concentration)

Using the obtained developing agent, an image is output on recording paper (manufactured by Fuji Xerox Office Supply, J paper) using a modified machine of DocuCenterColor400. Specifically, an initial image (a 4 cm square image having an image concentration of 100%) is printed on 10 sheets under the condition of 28° C./85% RH. Then, an image having a low area coverage (an image having a surface area of an image portion of 1% with respect to the total of the image portion and a non-image portion) is printed on 100,000 sheets, and an image for evaluation (a 4 cm square image having an image concentration of 100%) is subsequently printed on 10 sheets. The obtained initial image and image for evaluation are compared, and whether the image concentration is decreased or not is measured by using an image concentration meter (trade name: X-Rite938, manufactured by X-Rite).

The evaluation criteria of the image concentration are as follows, and the result of evaluation is shown in Table 1.

G1: Decrease in the measured value of the concentration is lower than 0.1

G2: Decrease in the measured value of the concentration is 0.1 or more and lower than 0.3

G3: Decrease in the measured value of the concentration is 0.3 or more and lower than 0.5

G4: Decrease in the measured value of the concentration is 0.5 or more

TABLE 1

| | Toner particles | | External additive particles | | | | |
|---|---|---|---|---|---|---|---|
| | | SF 1 | | Surface area ratio (fold) | $R^1$ (nm) | Presence or absence of specific particle size particles (particle size) | Evaluation result |
| Example 1 | 1 | 130 | 1 | 0.42 | 180 | Present (80 nm) | G1 |
| Example 2 | 1 | 130 | 2 | 0.40 | 180 | Absent | G2 |
| Example 3 | 1 | 130 | 3 | 0.16 | 180 | Absent | G2 |
| Example 4 | 1 | 130 | 4 | 0.47 | 180 | Absent | G1 |
| Example 5 | 1 | 130 | 5 | 0.39 | 90 | Present (30 nm) | G2 |
| Example 6 | 1 | 130 | 6 | 0.40 | 450 | Absent | G1 |
| Example 7 | 1 | 130 | 7 | 0.42 | 70 | Absent | G2 |
| Example 8 | 1 | 130 | 8 | 0.38 | 600 | Absent | G2 |
| Example 9 | 2 | 115 | 1 | 0.42 | 180 | Present (80 nm) | G3 |
| Example 10 | 3 | 150 | 1 | 0.40 | 180 | Present (80 nm) | G3 |
| Comparative Example 1 | 1 | 130 | 9 | 0.06 | 180 | Present (80 nm) | G4 |
| Comparative Example 2 | 1 | 130 | 10 | 0.62 | 180 | Present (80 nm) | G4 |

It is apparent from the result in Table 1 that decrease in the image concentration is more suppressed in Examples as compared to Comparative Examples.

What is claimed is:

1. A toner for developing an electrostatic image, comprising toner particles having a shape factor SF1 of 110 or more and comprising a binder resin, and particles of an external additive that adhere to the toner particles, the particles of the external additive comprising first particles, the first particles being silica particles, and second particles which are adhered to the first particles and have a primary particle size of 0.2 times to 0.5 times as large as that of the first particles, and in an image obtained by observing the particles of the external additive with a microscope, when the projection surface area of the first particle is defined as $S_1$ and the total of the projection surface areas of the second particles which are not hidden by the first particle is defined as $S_2$, $S_2$ being from 0.1 times to 0.5 times as large as $S_1$.

2. The toner for developing an electrostatic image of claim 1, wherein the primary particle size of the first particles is from 80 nm to 500 nm.

3. The toner for developing an electrostatic image of claim 1, wherein the particles of the external additive comprise the second particles having a primary particle size of from 0.35 times to 0.5 times as large as the primary particle size of the first particles.

4. The toner for developing an electrostatic image of claim 1, wherein a shape factor SF1 of the toner particles is from 110 to 140.

5. The toner for developing an electrostatic image of claim 1, wherein a shape factor SF1 of the first particles is from 100 to 130.

6. The toner for developing an electrostatic image of claim 1, wherein the first particles and the second particles have been prepared by sol-gel methods.

7. The toner for developing an electrostatic image of claim 1, wherein the binder resin is a polyester resin.

8. The toner for developing an electrostatic image of claim 1, wherein a glass transition temperature of the binder resin is from 35° C. to 100° C.

9. The toner for developing an electrostatic image of claim 7, wherein the binder resin is a polyester resin comprising structural units derived from a bisphenol A ethyleneoxide adduct and a bisphenol A propyleneoxide adduct.

10. The toner for developing an electrostatic image of claim 1, further comprising a release agent, wherein the release agent is included in the range of from 1% by weight to 10% by weight of the toner particles.

11. The toner for developing an electrostatic image of claim 10, wherein the release agent has a main endothermic peak temperature as measured according to ASTMD3418-8 in the range of from 50° C. to 140° C.

12. The toner for developing an electrostatic image of claim 10, wherein a viscosity $\eta 1$ of the release agent at 160° C. is in the range of from 20 cps to 600 cps.

13. The toner for developing an electrostatic image of claim 10, wherein the release agent is a paraffin wax.

14. An electrostatic image developer, comprising the toner for developing an electrostatic image of claim 1 and a carrier.

15. The electrostatic image developer of claim 14, wherein the carrier comprises ferrite particles.

16. The electrostatic image developer of claim 14, wherein the carrier is a resin-coat carrier and carbon black is included in a resin of the resin-coat carrier.

17. The electrostatic image developer of claim 14, wherein the carrier is a resin-coat carrier and melamine resin particles are included in a resin of the resin-coat carrier.

18. The toner for developing an electrostatic image of claim 1, wherein the primary particle size of the second particles includes at least a first particle size and a second particle size that is different from the first particle size.

* * * * *